US005440526A

United States Patent [19]

Pierce et al.

[11] Patent Number: 5,440,526

[45] Date of Patent: Aug. 8, 1995

[54] LOW ENERGY ANIMATED TIME PIECE

[75] Inventors: Harold D. Pierce, Westlake Village, Calif.; Stephen C. Jacobsen; William B. Lee, both of Salt Lake City, Utah

[73] Assignee: Sounds Fun, Inc., Northridge, Calif.

[21] Appl. No.: 291,341

[22] Filed: Aug. 15, 1994

Related U.S. Application Data

[63] Continuation of Ser. No. 775,308, Oct. 11, 1991, abandoned, which is a continuation-in-part of Ser. No. 625,485, Dec. 11, 1990, Pat. No. 5,197,044.

[51] Int. Cl.[6] ..... G04B 21/08

[52] U.S. Cl. ..... 368/63; 368/229; 368/281; 368/276

[58] Field of Search ..... 368/276, 280–282, 368/229, 63, 45, 272

[56] References Cited

U.S. PATENT DOCUMENTS

| | | | |
|---|---|---|---|
| D. 288,343 | 2/1987 | Ogawa | D21/144 |
| 344,922 | 7/1886 | Rebentisch | 368/220 |
| 373,441 | 11/1887 | Chase | 368/220 |
| 2,026,990 | 1/1936 | Manning | 46/171 |
| 2,165,037 | 7/1939 | Ellis et al. | 175/336 |
| 2,504,811 | 4/1950 | Davis et al. | 368/272 |
| 2,671,863 | 3/1954 | Matthews | 310/36 |
| 2,863,103 | 12/1958 | Tancred | 317/197 |
| 2,926,487 | 3/1960 | Stone | 368/220 |
| 3,021,666 | 2/1962 | Stone | 368/220 |
| 3,287,849 | 11/1966 | Weiss | 46/232 |
| 3,660,932 | 5/1972 | Raffeli et al. | 46/235 |
| 3,828,469 | 8/1974 | Giroud | 46/245 |
| 4,484,408 | 11/1984 | Fogarty et al. | 446/299 |
| 4,571,199 | 2/1986 | Murakami | 446/73 |
| 4,843,497 | 6/1989 | Leyden | 360/79 |

OTHER PUBLICATIONS

Article entitled "Introducing . . . Talk".

*Primary Examiner*—Bernard Roskoski

*Attorney, Agent, or Firm*—Fulwider Patton Lee & Utecht

[57] ABSTRACT

A wristwatch mounting an animated head of a figure and including a moveable nose overlying a watch face and formed by one end of a moveable member, the opposite end forming an armature. The moveable member is mounted on a laterally extending pivot pin such that magnitude of the torque due by the gravitational pull on such centers of mass on the opposite sides of such pivot pin are equal. A integrated circuit is provided which combines the capability to control clock functions, actuate the animation feature, synthesize speech and drive a dynamic speaker to provide overall control of the animation from a single actuation. Firmware incorporated in the integrated circuit includes means to selectively vary the message and comment in order to provide enhanced animation and novelty.

10 Claims, 4 Drawing Sheets

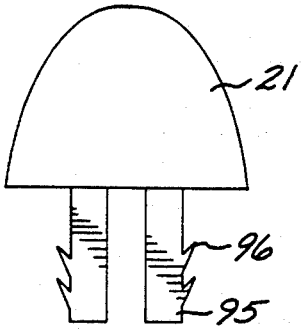
FIG. 4A
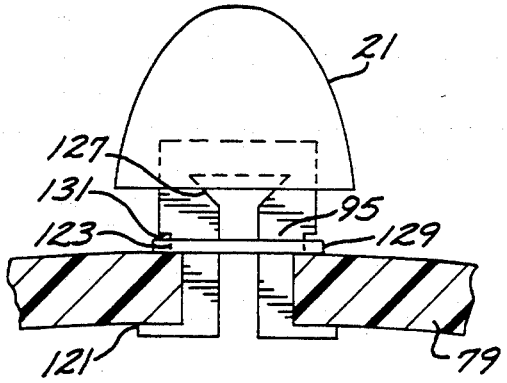
FIG. 4B
FIG. 4C
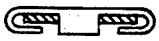
FIG. 5
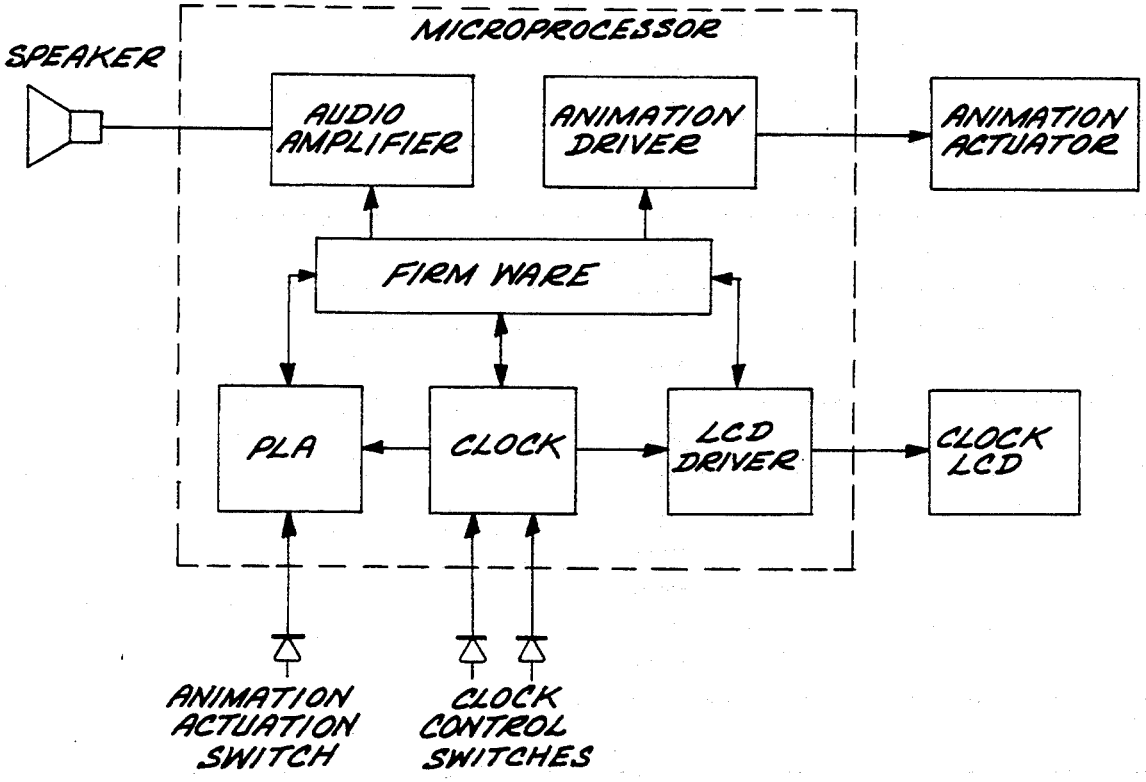

LOW ENERGY ANIMATED TIME PIECE

RELATED APPLICATION

This application is a continuation of application Ser. No. 07/775,308, filed Oct. 11, 1991, now abandoned which is a CIP of USSN 07/625,485 filed Dec. 11, 1990, now U.S. Pat. No. 5,197,044.

BACKGROUND OF THE INVENTION

1. Field of the Invention

The present invention relates to battery powered animated figures and more particularly to animated timepieces.

2. Description of the Prior Art

The popularity of novelty wrist watches and the like has led to the development of numerous different styles of watches and clocks displaying different novelty figures on the faces thereof. Some of these timepieces incorporate a depiction of the hands of such figures as the hands or sweep hand on the faces of the timepieces.

The popularity of cartoon and television characters has led to the proposal of timepieces incorporating three dimensional depictions of such characters. Devices of this type are shown in U.S. Pat. No. Des. 288,343 to Owaga. Watches of these types, while being satisfactory for their intended uses, fail to incorporate animated three dimensional figures, and thus are limited in their appeal as novelty and educational items.

Cartoon characters are distinctly characterized by not only their appearance, but also by their voices and mannerisms, including their speech phraseology and content. Thus, it would be desirable if a timepiece embodied not only the external appearance of the character, but also included means to provide a total animated and audible characterization of the character as it is usually presented to the public. The present invention satisfies all of these highly desirable goals in an efficient, simple and realistic timepiece which is easily operated and resistant to damage.

SUMMARY OF THE INVENTION

There has long existed a need for a wrist watch device incorporating a three dimensional novelty figure with an animated portion which could be powered by conventional electric watch batteries without consumption of undue energy. While the incorporation of a low energy consumption animation feature is desirable in and of itself, the present invention is also highly advantageous in that it provides in a single low energy consumption integrated circuit functional elements which control the clock circuit, animate the moving portion of the figure and synthesize speech in synchronized response to simple control inputs. These control inputs may be caused by switches placed on the timepiece which are depressed by the operator through a soft external cover representing the character. The moving part of the character is attached to the armature portion of the low energy consumption animation means.

In order to properly control the synchronization of the various functions incorporated in a single integrated circuit, firmware incorporated into the integrated circuit may be used to control the speech synthesizer, programmable logic array (PLA) and liquid crystal display (LCD) clock driver and to vary the way in which time is annunciated and the saying or greeting used before and after the time is stated.

The timepiece is formed in a plurality of subassemblies in order to provide for an efficient and robust consumer product. The interior of the watch is fabricated to include a first sub-assembly of integrated circuit and LCD display which also incorporates the actuation switches and batteries. Fastened to and located nominally above the first subassembly is a second subassembly housing the low energy actuation means and a speaker, which is of the higher efficiency dynamic type. The second subassembly is preferably hemispherical and forms the interior of the character figure. A soft outer hood in the shape and color pattern of the character is then fastened over the exterior of the subassemblies to form a smooth overall outer shape. The animated feature is attached to the internally mounted low energy animation means by an extension fastened to the armature of the low energy animation means. The smooth, soft outer shape for the figure and animated feature reduce the chance of accidental damage that would otherwise be present in a high profile watch or the like.

The soft outer hood is formed by injection moulding rather than conventional centrifugal moulding means used for such figures in order to provide dimensional correctness in interior dimensions, thus allowing the hood to fit securely and smoothly over the rigid inner assembly housing the animation means, speaker and electronics. The soft outer hood includes a perforated area on the exterior portion over the dynamic speaker, which is helpful to accurately reproduce the synthesized character voice. The soft outer hood is also internally configured such that areas in the hood corresponding to the switch location are relatively thick and rigid, while the adjacent areas are thinner in cross section, thereby providing an approximation to a free standing push button in the hood for relatively easy actuation of the switches.

In order to provide a low energy feature animation means, the present invention incorporates an armature which is selectively energized to move an animated figure part and which is also balanced against the weight of such animated part. While balanced armatures have been proposed in the past for relays, switches and the like, none of those devices have been generally accepted in a wrist watch construction employing an animated figure. The animated wrist watch of the present invention also addresses the problem associated with application of high acceleration forces to the animated figure part and associated armature resulting from rapid wrist movement. While attention has, in the past, been given to efforts to minimize forces imposed on dynamic parts as a result of forces of acceleration, none have attained optimum results in minimizing forces applied to moveable figure parts in a wrist watch apparatus.

The animation apparatus of the present invention incorporates an elongated pivotable member formed on one extremity with an animated figure part and on the opposite end with an armature portion disposed in the magnetic field of a magnet. The pivotable member is balanced on a transverse pivot pin to thus minimize the torque required to pivot and to minimize any imbalance due to acceleration induced forces. Preferably, the pivot member is configured such that an axis formed by a straight line between the centers of mass on opposite sides of the axis substantially intersects the axis of the pivot pin to thereby further minimize the effect of acceleration forces applied to such moveable member. Further, a ferromagnetic pull pin may be mounted on the armature in such a position that it will be normally drawn by such magnet to a position where the moveable figure part in a preferred position.

From the above, it will be appreciated that the present invention presents a novel and attractive animated timepiece which is also energy efficient and compact. The use of an integrated circuit incorporating programmable logic arrays allows for the integration in a single chip of the clock control, animation control and speech synthesis features. Such integration improves the ability of the invention to lend personality to the character depicted, including choices of content and order of announcement and phraseology, thereby improving the novelty and educational value of the invention. Other advantages and benefits of the invention will be apparent from the following detailed description which illustrates, by way of example, the features of the invention.

BRIEF DESCRIPTION OF THE DRAWINGS

FIG. 4*a* is a plan view of a preferred embodiment of the nose tabs.

FIG. 4*b* is a plan view of a second preferred embodiment of the nose tabs.

FIG. 4*c* is a cross sectional view of a nose tab locking device for use with the tabs of FIG. 4*b*.

FIG. 5 is a block diagram of the functional arrangement of the various components of the animated timepiece.

DESCRIPTION OF THE PREFERRED EMBODIMENT

The present invention provides an animated timepiece which includes, in a single assembly, time display means, preferably an LCD display; integrated circuit means, including means to control and actuate said LCD, voice synthesizer means, animation control means, firmware to synchronize the functions of said integrated circuit; actuator means to operate an animated member in response to said animation control means; switch means to allow selective actuation of said integrated circuit; speaker means to transmit sound corresponding to said voice synthesizer means and a soft overall hood formed in the shape of a cartoon character or the like.

Figure 1:
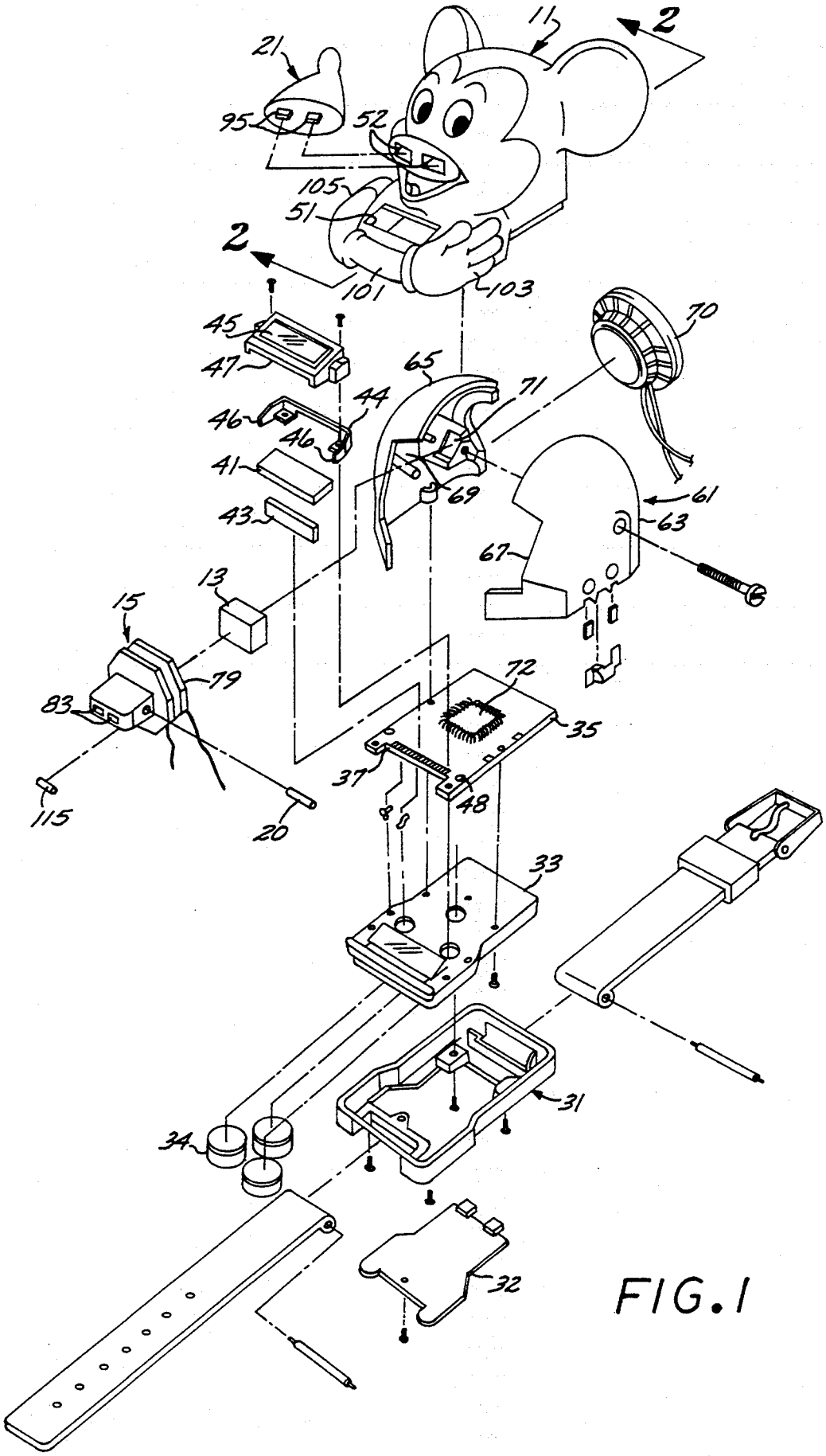
FIG. 1 is an exploded view of an animated wrist watch embodying the present invention.
Figure 2:
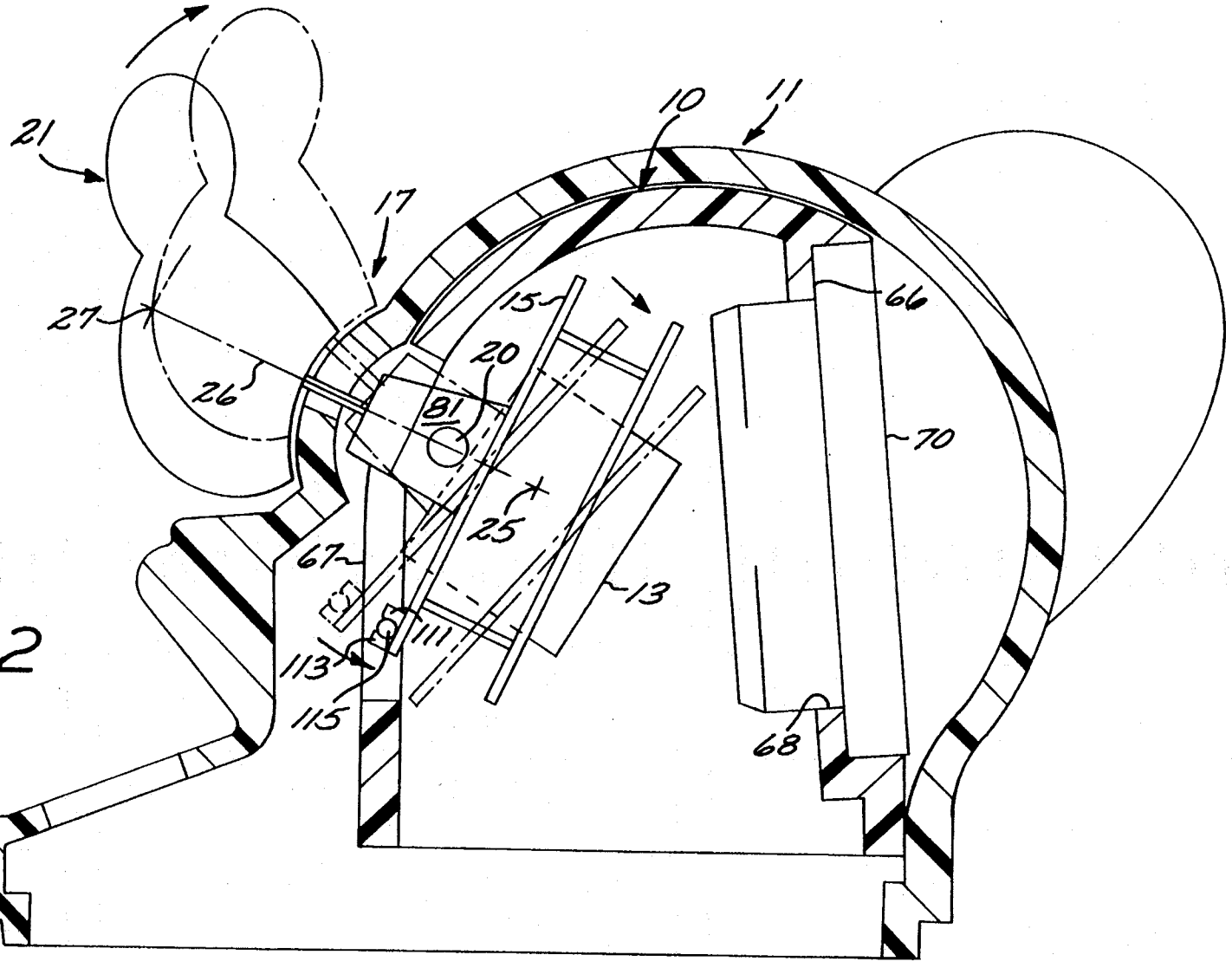
FIG. 2 is a cross sectional view, in enlarged scale, of the wrist watch shown in FIG. 1 but in its assembled configuration.

Referring to FIGS. 1 and 2, the animated time device of the present invention includes, generally, a housing 10 covered by a soft hood 11 simulating the configuration of a novelty figure such as a well known cartoon character as, for example, Mickey Mouse's head. A permanent magnet 13 is received within the opening of a generally donut shaped bobbin defining an armature 15. The armature 15 is formed by one end of a pivotable member, generally designated 17, mounted on a pivot pin 20, the opposite end thereof simulating the nose 21. Because the weight of the moveable member 17 is about e,fra 1/3× that of the armature 15, so as to minimize the energy required to rotate such moveable member about the pivot pin 20, the center of mass 27 for the nose portion 21 is spaced about three times as far from such pivot pin as that for the center of mass 25 for the armature 15. Consequently, upon controlled intermittent energization of the armature 15, the moveable member 17, and consequently the nose 21, will be rotated about the pivot pin 20 in accordance with a predetermined signal to thereby simulate talking by the figure.

The wrist watch depicted in FIG. 1 includes, generally, a conventional frame back 31 covered on one side by a back wall 32 and opening upwardly for receipt in stacked fashion a formed plate defining a battery bay 33 for receipt of conventional watch batteries 34. A printed circuit board 35 overlies the battery bay 33, mounts contacts 48 on the opposite sides thereof and is formed with a forwardly opening notch 37. Received in such notch 37 is a rectangular LCD 41 which overlies an LCD connector 43 and is positioned for viewing through a window 45 formed in an LCD frame 47, such window being disposed in alignment with a window 51 in the hood 11.

A U-shaped, electrically conductive audio switch contact actuator 44 overlies the printed circuit board 35 and is formed with a pair of laterally disposed resilient wings 46 having respective free ends which, in the assembled configuration, are normally spaced from the respective contacts 48 to thus provide a normally open switch. Closure of such contact actuator 44 on such contacts 48 then grounds the circuit to actuate a speech synthesizer that drives the armature 15 to initiate controlled actuation of the nose 21 in synchronization with the synthesized speech.

Figure 3:
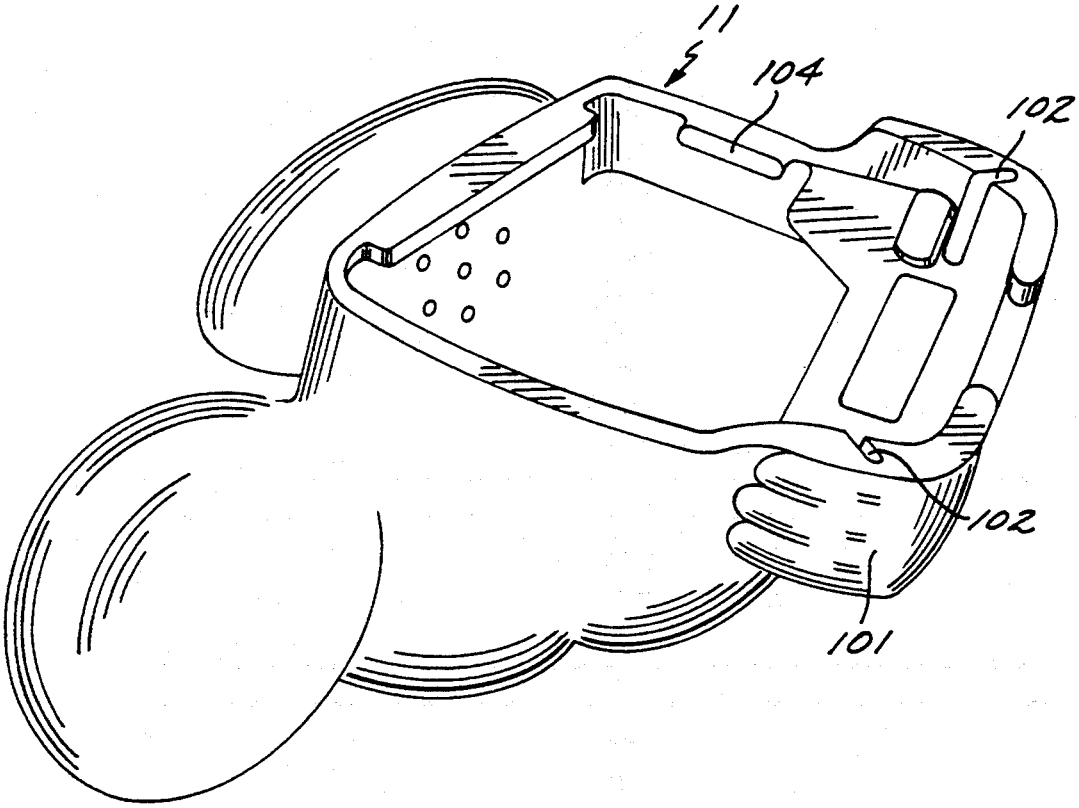
FIG. 3 is a lower exterior view of the exterior hood of the invention.

The hood 11 is of an injection molded mask type figure constructed of, for instance, polyvinylchloride and is received over an interior somewhat hemispherically shaped shell defining the skull housing 10. The hood 11 is formed in the mouth area with forwardly opening slots 52 which confront the forward end of the pivotable member 17. The hood is formed in its lower forward section with a configuration depicting wraparound arms 101 having hands 103 and 105 disposed on the opposite sides thereof for being disposed in confronting relationship over the wings 46 of the contact actuator 44 such that upon pressing such hands together the wings will engage the contacts 48 to ground the circuit 72 and initiate the voice memory to actuate the speaker 70 and the armature 15 in synchronism therewith. The hands are formed in the soft exterior of the hood such that the hands are easily depressed to engage contacts 48. In practice, it has been found that such arms 101 are advantageously formed such that the interior is selectively hollowed and/or slotted to allow easy depression of the arms in the area immediately adjacent the switches. FIG. 3 illustrates a lower view of such a configuration in a preferred embodiment of the invention. As illustrated in FIG. 3, arms 101 are formed such that slots 102 are operative to partially decouple the arms from the rest of the hood, thereby allowing the arms to be relatively easily pressed to cause contact 48 to be depressed. Preferably, hood 11 is also formed so that the interior is relatively thin in the areas adjacent the arms so that the arms are further decoupled from the overall hood structure. Similarly, the hood can be selectively thinned in the area near clock setting and adjustment contacts 104 in order to allow easy depression of the contacts through the outside cover, which also provides insulation of the electronics from the elements. In practice, such increases in thickness of the hood in the areas overlying the switches, coupled with selective thinning of the hood in the areas adjacent the switches, serves to create the effect of a free standing push button over the switch.

The nose 21 of the figure is formed with rearwardly projecting tabs 95 which project through the slots 52. The skull housing 10 is constructed of two clam shell halves 63 and 65, formed with respective forwardly facing notches 67 and 69 disposed in confronting relationship with the nose 21. FIG. 4 illustrates a preferred embodiment of the means of attaching nose 21 to armature 15. As illustrated in FIG. 4*a*, tabs 95 are preferably formed with barbs 96 which are used to engage the bobbin 79 of armature 15. In a current preferred alternative embodiment, illustrated in FIG. 4*b*, nose 21 is fabricated to include tabs 95 that extend into the bobbin 79. Tabs 95 include shoulders 121 and 123 which border a parallel pair of longitudinal areas 125 of tabs 95 located proximally on tabs 95 is a reduced cross section, generally indicated as 127, which allows the tabs to be deflected towards one another when a collar 129, shown in cross section in FIG. 4*c*, is placed over the tabs prior to installation. After tabs 95 are placed in slots in the bobbin 79, collar 129 is moved towards shoulder 123 until it locks in a small detent 131, thereby locking the collar in place and preventing the withdrawal of the tabs 95 from the bobbin 79. In practice, it has been found that such an assembly effectively can use a spring stainless steel of low magnetic properties such as 308 stainless steel.

The interior of the back of the skull housing halves 63 and 65 are formed with upwardly and forwardly facing platens 71 which cooperate to form a mount for the generally rectangular shaped magnet 13 (FIG. 1). Formed in the back wall of the respective skull housing halves 63 and 65 is a mounting recess 66 into which a circular opening 68 is formed for receipt of a speaker 70 connected to a integrated circuit 72 (FIG. 1) with the batteries 34 and armature 15 for selected actuation thereof to emit a pre-established voice.

The armature 15 includes a frame formed with spaced apart planar rings defining a bobbin 79 mounting a forwardly projecting tongue 81. Formed medially in the tongue 81 is a transversely projecting bore 85 for receipt of the pivot pin 20 which serves to pivotally mount the assembled pivot member 17 from the skull halves 63 and 65. The tongue 81 terminates in its front face with a pair of forwardly opening slots 83 confronting the slots 52 in the hood 11 (FIG. 1). The frame of the armature 15 is formed in its lower forward portion with forwardly projecting parallel flanges 111 and 113 spaced apart for receipt therebetween of a soft iron wire segment 115 which serves as a ferromagnetic pull pin disposed in the magnetic field of the magnet 13 to thus normally bias the pivotal member 17 to its counterclockwise position disposing the nose 21 in its closed position. It will be appreciated that the magnetic pull on the pull pin, while of a relatively small magnitude, will be sufficient to in effect bias the nose 21 to the mouth closed position without application of independent biasing forces which would otherwise have to be overcome to effect manipulation of the nose 21. Thus, this feature decreases the chance that the nose will be damaged from forces and rough use, and increases the appeal and realism of the timepiece. It should also be noted that while it would have been possible to use a spring to bias the nose to the closed position, the use of magnetic biasing means provides important advantages. For example, magnetic biasing means exert little force after movement away from the magnet, thus decreasing the power required to fully open and hold open the nose. Thus, this approach has important advantages in the present invention, which will often employ limited power means such as a battery.

So as to minimize the effects of acceleration induced forces, the centers of mass 25 and 27 of the respective armature 15 and nose 21 are preferably arranged on a straight line defining a balance axis 26 which intersects the axis of the pivot pin 20 to thus result in the cumulative acceleration induced forces acting essentially through the axis of the pivot pin 20 thereby nullifying any cumulative torque which might otherwise resist or assist rotation of the pivotable member 17 about its axis pin 20. When the wearer of the watch, for instance a young child, moves his wrist about in a rapid manner, acceleration forces will be applied to the watch itself and, of course, to the moveable member 17. It will be appreciated by those skilled in the art that since the axis 26 of the pivot member 17 extending between the centers of mass 25 and 27 essentially intersect the pivot axis formed by the pivot pin 20, the effect of the various acceleration forces in opposing rotation about such pin will be minimized. It has been found that, even if such an ideal configuration is not practical, for the embodiment shown, the perpendicular distance (i.e. shortest distance) from such axis 26 to the axis of the pivot pin should be no greater than about 0.1 inches.

For the particular configuration shown, the nose portion 21 weighs about 3.3 grams and the armature section 15 about 9.0 grams thus providing a ratio of approximately 3 to 1 between the nose and the armature. With the center of mass of the coil located about four millimeters from the axis of the pivot pin 20 and that for the nose section about twelve millimeters from such pivot axis, it has been discovered that the static equilibrium will be afforded, thus maintaining the net torque necessary to reciprocate the pivotal member 17 substantially constant.

Integrated circuit 72 is designed to incorporate in a single chip all of the functions previously incorporated in a plurality of individual circuits, thus improving the power consumption and flexibility of the system while reducing size and complexity of the connections to the electronic circuit. In particular, the integrated circuit incorporates in a single chip the function of speech synthesizers, programmable logic array (PLA) and liquid crystal clock (LCD) driver. Firmware in the integrated circuit is used to control the PLA and result in a variety of messages used to announce the time in response to control inputs. For example, in a presently preferred embodiment, the phrases are randomly selected from a variety of pre-stored ones in the speech synthesizer. In such an embodiment, a timing function is included so that a different announcement is chosen than the one previously given. In a preferred embodiment it has been found to be desirable to include a plurality of time announcements such as "six oh five" and "five after six" or the like. Also, a number of pre and post phrases may be chosen. Thus, the combination of time announcement and phrase may be chosen to add personality and character, as well as educational value to the use of the invention. In a presently preferred embodiment, alternating time announcements and random selection of phrase from six available phrases has proven to be educational and appealing to children.

The single integrated circuit arrangement was necessary in order to achieve the goals of low power, speech synthesis and programmable flexibility that have previously not been achieved with animated timepieces. In order to optimize the features of the invention, the integrated circuit is configured to include a speaker driver capable of driving a dynamic speaker, thus providing a more realistic and recognizable voice synthesis of the character. FIG. 6 is a schematic diagram of a timepiece of the present invention, depicting the arrangement of the various functional elements.

When it is desired to actuate the animated mechanism, the hands 103 and 105 (FIG. 1) are pressed inwardly toward one another, thus closing the wings 46 of the contact actuator 44 on the contracts 48 to ground the circuit 42 as described above. This acts to energize the voice memory to drive the speaker 70 and pivotable member 17 to move the nose 21 to synchronize with the voice. In this regard, when the armature is energized, its magnetic field will tend to align with that of the magnet 13 thus overcoming the attraction of the pull wire 115 to such magnet. This will serve to rotate the armature 15 and consequently the pivot member 17 counterclockwise about the pivot pin 20 to drive the nose portion 21 upwardly. Once the electrical signal to the armature 15 is discontinued, the magnetic attraction on the pull wire 115 will rotate the pivotal member 17 counterclockwise to close the nose portion 21. This movement is synchronized in a manner well known to those skilled in the art with voice fluctuation emitted from the speaker 70 to simulate speaking of the figure.

From the above, it is evident that the animated timepiece of the invention provides heretofore unavailable levels of realism and novelty in the representation of cartoon characters and the like. It will also be apparent to those skilled in the art that the animated timepiece of the present invention is robust, inexpensive to manufacture and reliable to operate. Operation of the animation requires only minimal power, thus leading to a long and trouble free service life.

While a particular form of the invention has been illustrated and described, it will be apparent that various modifications can be made without departing from the spirit and scope of the invention. Accordingly, it is not intended that the invention be limited, except as by the appended claims.

I claim:

1. A low energy consumption animated miniature timepiece comprising:

a three dimensional figure of an animated character, including at least one movable feature of said character;

time display means;

a magnet mounted on said housing;

balanced animation means operative to move said moveable feature in response to an animation signal, said animation means including an electromagnet, said electromagnet and said moveable feature being balanced in combination as an assembly with said magnet mounted on said housing;

voice synthesizer means operative to generate an electronic speech synthesizer signal representing a predetermined voice characteristic in response to a voice actuation signal;

clock means operative to control said time display means and provide a time standard in response to clock control signals;

means for selecting a first announcement phrase;

means for inputting a time to be integrated into said first announcement phrase;

means for selecting a second announcement phrase;

means for creating a composite announcement incorporation said first announcement phrase and said second announcement phrase;

means for synchronously generating an animation signal and said synthesizer signal;

means for generating clock control signals in response to an external input; and sound reproduction means for announcing said composite announcement responsive to said speech synthesizer signal.

2. The timepiece of claim 1 wherein said time display means is a digital liquid crystal display.

3. The timepiece of claim 1 wherein said animation means comprises electromagnet means operative to cause a moveable appendage to move in response to an input animation signal.

4. The timepiece of claim 1 wherein said voice synthesizer, said clock control means and said animation signal generation means are contained in a single integrated circuit.

5. The timepiece of claim 4 which further comprises programmable logic to allow for the selective functional arrangement of output signals.

6. The timepiece of claim 5 wherein said programmable logic is controlled by firmware.

7. The timepiece of claim 1 wherein said voice synthesizer means further comprise:

means to store a plurality of clock announcement phrases;

means to store a plurality of phrases to be used before and after said clock announcement phrases; and means to select a plurality of announcements from said phrases.

8. The timepiece of claim 1 wherein said sound reproduction means comprises a dynamic electromagnetic speaker.

9. A method of animating a low energy consumption miniature timepiece incorporating a representation of a character comprising;

balancing a moveable appendage mounted to an electromagnet between a first position in which said moveable appendage is biased toward a magnet in said timepiece, and a second position;

inputting a signal to actuate said timepiece;

selecting a first announcement phrase;

inputting the current time to be integrated into said time announcement phrase;

selecting a second announcement phrase;

creating a composite announcement incorporating said first announcement phrase, and said second announcement phrase;

synthesizing a speech signal incorporating said composite announcement; and generating an animation signal in synchronization with said speech signal to cause said electromagnet to move said moveable appendage to move from said first position to said second position.

10. The method of claim 9, further comprising the step of:

randomly selecting said pre-announcement and post-announcement phrases to be combined with a predetermined selection of said time announcement phrase.

* * * * *

UNITED STATES PATENT AND TRADEMARK OFFICE

CERTIFICATE OF CORRECTION

PATENT NO. : 5,440,526

DATED : August 8, 1995

INVENTOR(S) : Pierce et al.

It is certified that error appears in the above-identified patent and that said Letters Patent is hereby corrected as shown below:

Column 3, line 64, " e,fra 1/3 " should read --1/3--.
Column 7, line 6, change "FIG. 6" to --FIG. 5--.

Signed and Sealed this

Twenty-sixth Day of March, 1996

*Attest:*

BRUCE LEHMAN

*Attesting Officer*

*Commissioner of Patents and Trademarks*